US010376930B2

(12) United States Patent
Becker et al.

(10) Patent No.: US 10,376,930 B2
(45) Date of Patent: Aug. 13, 2019

(54) ROTATING CLEANER

(71) Applicant: GEA TUCHENHAGEN GMBH, Buchen (DE)

(72) Inventors: Kai Becker, Hamburg (DE); Richard Collins, Cradley (GB)

(73) Assignee: GEA TUCHENHAGEN GMBH (DE)

( * ) Notice: Subject to any disclaimer, the term of this patent is extended or adjusted under 35 U.S.C. 154(b) by 0 days.

(21) Appl. No.: 15/558,685

(22) PCT Filed: Mar. 14, 2016

(86) PCT No.: PCT/EP2016/055409
§ 371 (c)(1),
(2) Date: Sep. 15, 2017

(87) PCT Pub. No.: WO2016/146564
PCT Pub. Date: Sep. 22, 2016

(65) Prior Publication Data

US 2018/0111167 A1 Apr. 26, 2018

(30) Foreign Application Priority Data

Mar. 18, 2015 (DE) ..... 10 2015 003 561

(51) Int. Cl.
*B05B 1/04* (2006.01)
*B05B 3/02* (2006.01)
(Continued)

(52) U.S. Cl.
CPC ..... *B08B 3/02* (2013.01); *B05B 1/044* (2013.01); *B05B 3/06* (2013.01); *B05B 13/0636* (2013.01);
(Continued)

(58) Field of Classification Search
CPC ..... B05B 1/044; B05B 1/046; B05B 3/026; B05B 3/06; B05B 13/0636; B08B 3/02; B08B 9/0936; B08B 2203/0247
(Continued)

(56) References Cited

FOREIGN PATENT DOCUMENTS

| | | |
|---|---|---|
| DE | 4328744 | 12/1981 |
| DE | 10006864 | 11/2001 |

(Continued)

OTHER PUBLICATIONS

English language translation of Written Opinion issued in connection with corresponding International Patent Application, pp. 1 to 7.

(Continued)

*Primary Examiner* — Levon J Shahinian
(74) *Attorney, Agent, or Firm* — Merek, Blackmon & Voorhees, LLC

(57) ABSTRACT

A rotating cleaner (1) comprising a housing (2) which has a cavity (10) and an inlet (9) which is connectable to a fluid supply line, a shaft (5) extending in sections into the cavity (10), a sprayer body (3) which is non-rotatably connected with the shaft (5) and has an outlet (8), and further comprising a sliding bearing for rotatably supporting the shaft (5) in the housing (2), said sliding bearing having a rotating bearing surface (23), an idle bearing surface (22) and a bearing gap. To improve the cleanability and the rotational characteristics of the rotating part, it is proposed that the rotating bearing surface (23) and the idle bearing surface (22) are each formed as a contiguous surface for supporting the shaft (5) in the radial and axial direction.

16 Claims, 3 Drawing Sheets

Figure 1:
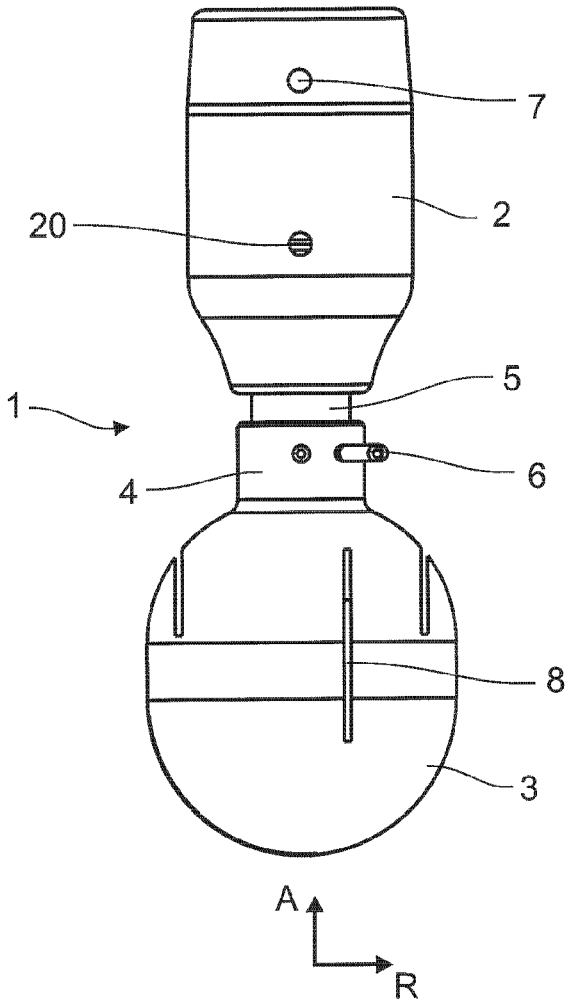

(51) Int. Cl.

| | |
|---|---|
| ***B05B 3/06*** | (2006.01) |
| ***B05B 13/06*** | (2006.01) |
| ***B08B 3/02*** | (2006.01) |
| ***B08B 9/093*** | (2006.01) |

(52) U.S. Cl.
CPC ..... *B08B 9/0936* (2013.01); *B05B 1/046* (2013.01); *B05B 3/026* (2013.01); *B08B 2203/0247* (2013.01)

(58) Field of Classification Search
USPC ..... 134/166 C, 180
See application file for complete search history.

(56) References Cited

FOREIGN PATENT DOCUMENTS

| | | | | |
|---|---|---|---|---|
| DE | 10130316 | | 8/2002 | |
| DE | 10143468 | | 6/2003 | |
| DE | 102005015534 | | 4/2006 | |
| DE | 102011078857 | | 1/2013 | |
| EP | 0694344 | | 1/1996 | |
| EP | 1582265 | A2 * | 10/2005 | ..... B05B 3/026 |
| FR | 2894853 | | 6/2007 | |
| GB | 1604650 | | 12/1981 | |

OTHER PUBLICATIONS

German Search Report issued in connection with corresponding German Patent Application, pp. 1 to 7.

* cited by examiner

ROTATING CLEANER

The invention relates to a rotating cleaner according to the preamble of the first claim.

Rotating cleaners are used to clean the interior space of containers such as storage tanks. They have a rotating sprayer body having one or more outlets from which a cleaning fluid is discharged. Rotation of the sprayer body causes the entire inner wall surface of the vessel to be wetted with cleaning fluid, wherever possible. These cleaners are mainly used in applications in which hygienic conditions must prevail, for example in the food industry, but they are also used in other industries.

The rotating sprayer body must be rotatably supported inside the housing of the cleaner. Ball bearings for this purpose are known from one design of this type of cleaner. Such a bearing is presented in DE 101 30 316 C1, for example. Balls arranged on bearing surfaces provided on a rotating assembly and on the housing provide rotatable support in the axial and radial direction. Rotation is produced by the fluid flowing into the cleaner, in that the fluid flows against twisted leaf springs provided inside the sprayer body.

Rotatably supporting the rotatable assembly with ball bearings is also shown in DE10 2005 015 534 B3.

The fluid exiting the sprayer body can be used to make the sprayer body rotate. This is described in DE 10 2011 078 857 A1, for example. The rotation is produced by the fluid entering the hollow sprayer body in a directed manner and by the fluid exiting the sprayer body. Another discharge nozzle is used to brake rotation.

Another design of the rotating cleaner switched to sliding bearings in order to provide rotatable support for the sprayer body.

A cleaner with a sliding bearing is presented in GB 1604650 A. A cylindrical part is arranged between the housing and the shaft of the rotating assembly and acts as a radial bearing. A flange-like section acting as a sliding bearing in the axial direction is provided at a right angle to the cylindrical part. The rotating assembly is driven by a ball which is propelled by the cleaning fluid and which presses against a projection provided on the rotating assembly.

The cylindrical bearing part with its flange-like section that acts as part of the sliding bearing and which belongs to a radial and an axial bearing, may be made of Teflon. This is proposed by DE 101 43 468 C1, which also relates to improvements concerning cleanability and rotational drive.

A rotating cleaner having a first radial and a second axial sliding bearing of the kind described here and having a sprayer body driven by the kickback of an exiting fluid is known under the trade name Turbo SSB.

The object of the invention is to provide a rotating cleaner which is easily cleaned and whose rotating assembly has good rotational characteristics.

This object is achieved with a rotating cleaner having the features of claim 1. Dependent claims 2 to 10 specify advantageous developments of the rotating cleaner.

The rotating assembly of the cleaner is supported rotatably by a sliding bearing which has a rotating and an idle bearing surface. These bearing surfaces are formed as contiguous surfaces and are designed in such a way that the assembly with the sprayer body is supported in the radial direction and the axial direction simultaneously by the sliding bearing provided by the bearing surfaces. Such a sliding bearing that acts as an angular contact bearing makes the sprayer body run more smoothly due to improved centering. Production is simplified due to the small number of surfaces that have to be manufactured with precision. Compared to the prior art it is therefore easier to achieve greater precision for the sliding bearing. This greater precision likewise improves the smooth running and rotational characteristics. Due to the smaller number of components and simpler geometry, the cleaner can be cleaned better and is less susceptible to dust and dirt, so it is easier to meet the applicable standards according to 3A and EHEDG. A contiguous surface is to understood specifically as a surface which is free of steps, ridges or kinks.

One design which is easily manufactured with regard to its effect is one in which rotating and idle bearing surfaces each have a conical shape. This design provides a sliding bearing which absorbs forces uniformly and with uniform guiding characteristics, thus resulting in smooth running. Smooth running increases the service life of the cleaner and improves its cleaning efficiency.

Axial and radial forces are distributed particularly uniformly, resulting in particularly smooth running, in an embodiment in which the generatrices of the conical bearing surfaces form an angle with a rotational axis of between 40 degrees and 45 degrees.

The running characteristics of the sliding bearing also depend on a fluid being fed into the gap between the bearing surfaces. An advantageous design in this respect is one in which a feed opening is provided in the shaft, through which the bearing fluid can enter the gap in the sliding bearing.

Even smoother rotation, and smooth running as a result, are obtained with a development of the invention in which a guide sleeve which is in sliding contact with the shaft and has limited play in an axial direction is provided in the cavity.

According to another development relating to guiding the bearing fluid, the housing is provided with an outlet opening which produces fluidic communication between the bearing gap and surroundings of the rotating cleaner. It is possible in this way for bearing fluid to escape from the bearing gap, thus allowing a replenishing flow of fresh fluid into the bearing gap. The fluid film between the bearing surfaces becomes more uniform as a result, and the fluid flowing out of the bearing gap cleans an outer wall of the cleaner.

According to yet another development of the invention, it is proposed that a spacer ring be provided between the idle bearing surface and the rotating bearing surface. This measure provides latitude in selecting the materials that form the bearing surfaces. For applications in which hygienic conditions must prevail, it is advantageous, for example to use stainless steel for the shaft and the housing on which the bearing surfaces are formed. A spacer ring providing bearing surfaces can be made, for example, of polytetrafluoroethylene, polyether ether ketone or similar materials. Having similar materials on bearing surfaces that contact each other can be circumvented by the spacer ring so that better bearing characteristics ensue. A spacer ring also protects the bearing surfaces when using an abrasive fluid.

The cleanability of the cleaner can be improved by detachably mounting the sprayer body on the shaft. This allows the parts to be taken apart easily and consequently to be cleaned more thoroughly than in the assembled state.

According to one development of the invention, another way of increasing and simplifying cleanability is to form an outlet on the sprayer body in such a way that fluid exiting through the outlet is made to rotate and to keep rotating. Fewer components are required inside the cleaner as a result of this design. The geometry is made simpler, so it is possible to dispense with parts and cavity sections that are difficult to clean.

A simple outlet design for achieving excellent propulsion characteristics as well as good throughput and a good spray pattern of cleaning fluid is an axially extending slot which penetrates the wall of the sprayer body at an incline counter to a radial direction.

The invention shall now be described in further detail with reference to an embodiment and developments of the invention, and the effects and advantages shall be described in greater depth.

Figure 2:
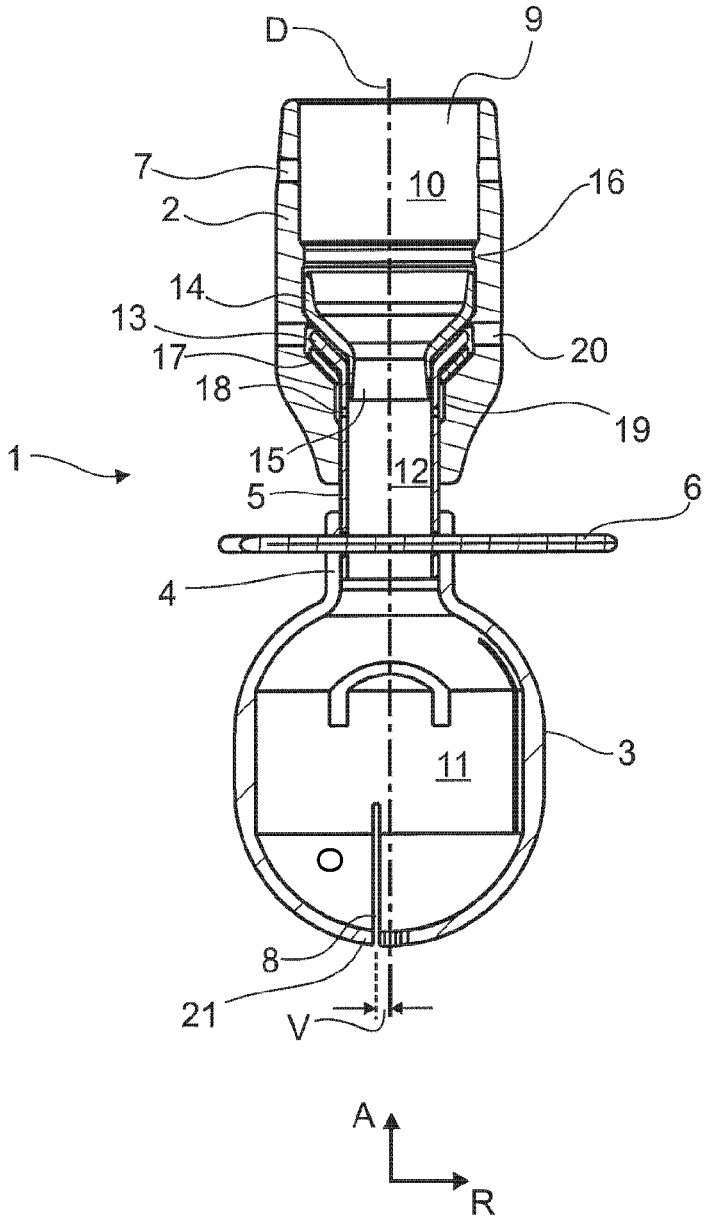

Reference is made to the Figures, in which:

FIG. 1: shows a side view of a rotating cleaner;

FIG. 2: shows a longitudinal cross-section through the rotating cleaner.

Figure 3:
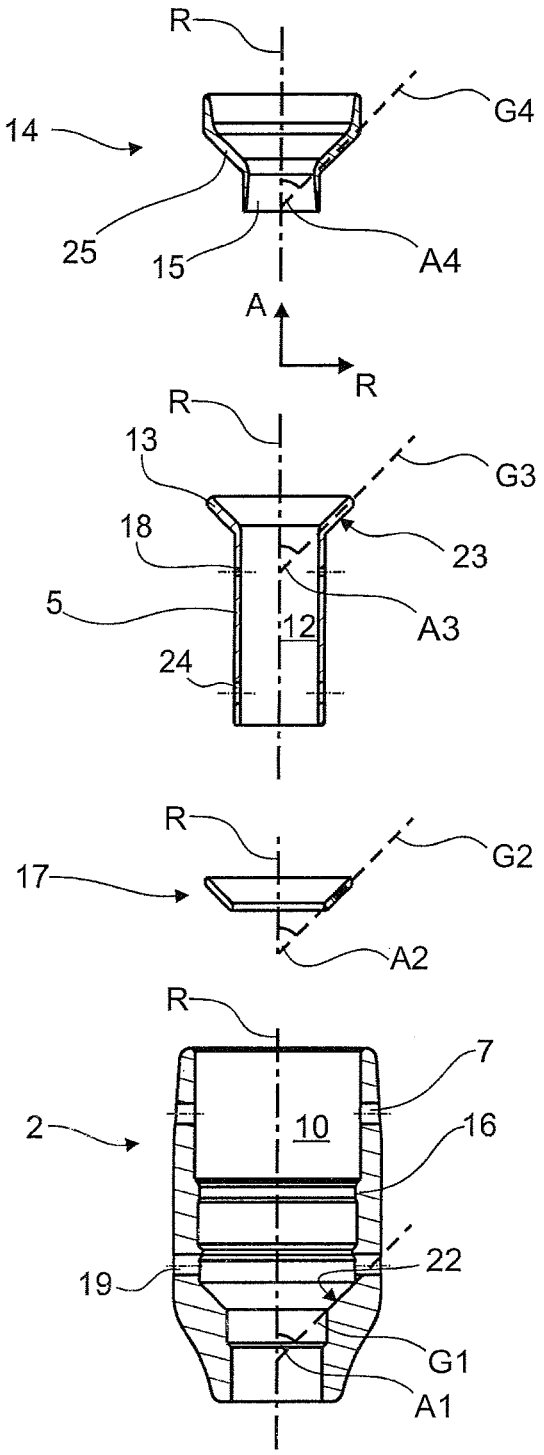

FIG. 3: shows, in exploded view, a longitudinal cross-section through the housing, the shaft, the guide sleeve and the spacer ring.

FIG. 1 shows a rotating cleaner 1 in a side view. Rotating cleaner 1 has a housing 2 and a rotatable sprayer body 3. Sprayer body 3 has a neck 4, in which a shaft 5 is received. A releasable connection between neck 4 and shaft 5 is effected by means of a clip 6. The housing 2 of cleaner 1 has pinholes 7. These allow cleaner 1 to be releasably connected to a feed line for fluids, not shown, for example for the cleaning fluid of a cleaning in place process, for example by means of a pin or a second clip.

At least one outlet for a cleaning fluid is provided on sprayer body 3. In this example, the outlet is designed as a slot 8 which runs along axial direction A.

In FIG. 2, rotating cleaner 1 is shown in cross-section along rotational axis R. Rotational axis R simultaneously specifies axial direction A.

The housing 2 of rotating cleaner 1 has an inlet 9, through which a predominantly liquid cleaning agent can penetrate into the cavity 10 inside cleaner 1, especially during a cleaning operation. Sprayer body 3 is likewise hollow and has an interior space 11. The inner surface of sprayer body 3 is preferably smooth and is penetrated only by at least one outlet which in the example is in the shape of a slot 8. Cavity 10 and interior space 11 are in fluidic communication with each other via a shaft interior 12 extending through shaft 5.

Shaft 5 has a bearing portion 13 at the end which faces housing 2. Bearing portion 13 is accommodated in a space which is formed between housing 2 and a guide sleeve 14. Guide sleeve 14 has a guide portion 15, which can be cylindrical in shape and which engages with shaft interior 12 of matching cylindrical shape. Guide portion 15 is specifically adapted to provide radial guidance for guide shaft 5 inside the housing and thus to aid stable rotation of shaft 5 about rotational axis R.

Movement of guide sleeve 14 along rotational axis R in the direction of inlet 9 is limited by a projection 16, which is shaped in such a way that it provides such limitation. Guide sleeve 14 can also be pushed through inlet 9 and over projection 16 and snaps into place with a little axial clearance in direction A.

The gap between housing 2 and guide sleeve 14, in which bearing portion 13 of shaft 5 is accommodated and in which a spacer ring 17 may be provided, is filled with fluid when the assembly consisting of sprayer body 3 and shaft 5 in made to rotate during operation of the cleaner. The fluid passes through at least one feed opening 18 into said gap. The gap may include, as one section, an axial gap 19 surrounding the cylindrical portion of shaft 5. The fluid then flows out of said axial gap 19 and between the actual bearing surfaces, and exits the gap and housing 2 of cleaner 1 through at least one outlet opening 20. It is advantageous for the flow of fluid when pluralities of feed openings 18 and outlet opening 20 are each distributed around the circumference. Supplying the sliding bearing with fluid in this manner results in adequate and uniform lubrication of the sliding bearing at all times, without the risk of fluid congestion or running dry.

The slot-shaped outlet in sprayer body 3 penetrates wall 21. Slot 8 is formed in wall 21 in such a way that the sprayer body is made to rotate by the pressurized fluid exiting the slot, for example a cleaning fluid with is suitable for hygienic processes. This is achieved, for example, by slot 8 being provided in the wall with an offset O counter to rotational axis R. Slot 8 advantageously extends through wall 21 at an incline counter to radial direction R.

FIG. 3 shows a cross-sectional exploded view of housing 2, sprayer body 3 and shaft 5, as well as spacer ring 17, which is not absolutely necessary but advantageous.

The order in which the components are shown in FIG. 3 is the same as the order in which these components are assembled. Spacer ring 17, if one is used, is firstly inserted into the cavity 10 of housing 2. Shaft 5 follows, then guide sleeve 14. As soon as the latter has been pushed over projection 16 and is restricted in its mobility in axial direction A, assembly of the components shown in FIG. 3 has been completed.

An idle bearing surface is formed in housing 2 of the rotating cleaner. It is conical in shape, and its geometry is produced by rotating a generatrix G1 about rotational axis R. Generatrix G1 forms an angle A1 with said rotational axis, which is in a range from 35 degrees to 45 degrees, advantageously in a range from 40 degrees to 45 degrees. This angular range is beneficial for absorbing the axial and radial forces that arise when the sliding bearing is in operation.

Spacer ring 17, which is advantageous but not absolutely necessary, depending on the intended operating conditions, may be conical in shape. A generatrix G2 forms an angle A2 with rotational axis R. To prevent material stresses, said angle A2 is equal to angle A1 or deviates from the latter by only a few degrees. Soft materials allow a greater deviation than hard materials do. The material is to be selected, on the one hand, with regard to the field of application, for example in the food industry, where the selected material must be non-harmful to health. On the other hand, it must be able to form that part of a sliding bearing, as the inner and outer conical surfaces of the spacer ring are in sliding contact with the actual bearing surfaces. One material that meets these requirements is polytetrafluoroethylene (PTFE), for example.

Bearing portion 13 of the basically cylindrical shaft 5 likewise has a basic conical shape. A generatrix G3 of said cone form an angle A3 with rotational axis R. Said angle A3 is also equal to angle A1, if and insofar as the production facilities allow. An outer surface of conical bearing portion 13 forms the rotating bearing surface 23 of the sliding bearing. In the region of shaft 5 adjacent the end facing away from bearing portion 13, shaft holes 24 are provided which are penetrated in the assembled state of rotating cleaner 1 by clip 6.

Shaft 5 may be made of polyether ether ketone (PEEK), or of a similar plastic material which is compliant with the mechanical and hygiene requirements and suitable for a sliding bearing. This obviates the need for spacer ring 17.

Guide sleeve 14 serves to stabilize shaft 5 in the axial direction and to improve rotation. Rotation is improved by guide portion 15 disposed at the end of the guide sleeve facing shaft 5, which is cylindrical in shape and extends into shaft interior 12. Due to the sliding contact between shaft 5 and the guide sleeve, rotation is improved. A sleeve cone 25 adjoins the guide portion on the side facing away from shaft 5. Sleeve cone 25 has a conical surface, the shape of which can be described with a generatrix G4. Generatrix G4 forms an angle A4 with rotational axis R. Said angle A4 is advantageously equal to angles A1, A2 and A3, to the extent that production facilities allow. The sleeve cone stabilizes the rotation of shaft 5. During operation of rotating cleaner 1, forces are generated that push shaft 5 in the upward axial direction in FIG. 3. Sleeve cone 25 absorbs these forces and thus stabilizes shaft 5 in the axial direction also.

LIST OF REFERENCE SIGNS

1 Rotating cleaner
2 Housing
3 Sprayer body
4 Neck
5 Shaft
6 Clip
7 Pinholes
8 Slot
9 Inlet
10 Cavity
11 Interior space
12 Shaft interior
13 Bearing portion
14 Guide sleeve
15 Guide portion
16 Projection
17 Spacer ring
18 Feed opening
19 Axial gap
20 Discharge opening
21 Wall
22 Idle bearing surface
23 Rotating bearing surface
24 Shaft holes
25 Sleeve cone
G1 Generatrix of the sleeve cone
G2 Generatrix of the rotating surface
G3 Generatrix of the spacer ring
G4 Generatrix of the idle surface
R Rotational axis
A Axial direction
R Radial direction
O Offset
A1 Angle of the idle surface
A2 Angle of G2
A3 Angle of the rotating surface
A4 Angle of G4

The invention claimed is:

1. A rotating cleaner (1) comprising a housing (2) which has a cavity (10) and an inlet (9) which is connectable to a fluid supply line, a shaft (5) extending in sections into the cavity (10), a sprayer body (3) which is non-rotatably connected with the shaft (5) and has an outlet (8), and further comprising a sliding bearing for rotatably supporting the shaft (5) in the housing (2), said sliding bearing having a rotating bearing surface (23), an idle bearing surface (22) and a bearing gap, characterized in that the rotating bearing surface (23) and the idle bearing surface (22) are each formed as a contiguous surface for supporting the shaft (5) in the radial and axial direction and further characterized in that the rotating bearing surface (23) and the idle bearing surface (22) are conical in shape and one of the rotating bearing surface and the idle bearing surface being integrally formed with the shaft adjacent an upper portion of the shaft and the other of the rotating bearing surface and the idle bearing surface supporting the shaft in the radial and axial direction.

2. The rotating cleaner (1) according to claim 1, characterized in that the rotating bearing surface (23) and the idle bearing surface (22) are each formed by a generatrix (G3, G1) which forms an angle (A2, A4) with a rotational axis (R) of between 40 degrees and 45 degrees.

3. The rotating cleaner (1) according to claim 2, characterized in that the shaft (5) has a feed opening (18) to allow bearing fluid into the bearing gap in the sliding bearing.

4. The rotating cleaner (1) according to claim 2, characterized in that a guide sleeve (14) is provided in the cavity (10), which is in sliding contact with the shaft (5) and has limited play in an axial direction.

5. The rotating cleaner (1) according to claim 2, characterized in that the housing (2) has an outlet opening (20) which provides fluidic communication between the bearing gap and surroundings of the rotating cleaner (1).

6. The rotating cleaner (1) according to claim 2, characterized in that a spacer ring (17) is disposed between the idle bearing surface (22) and the rotating bearing surface (23).

7. The rotating cleaner (1) according to claim 2, characterized in that the sprayer body (3) is detachably mounted on the shaft (5).

8. The rotating cleaner (1) according claim 2, characterized in that the sprayer body (3) has an outlet, the shape of which causes the sprayer body (3) to rotate when fluid is discharged.

9. The rotating cleaner (1) according to claim 2, characterized in that it has a slot (8) extending along an axial direction (A) and penetrating a wall (21) of the sprayer body (3) at an incline counter to a radial direction (R).

10. The rotating cleaner (1) according to claim 1, characterized in that the shaft (5) has a feed opening (18) to allow bearing fluid into the bearing gap in the sliding bearing.

11. The rotating cleaner (1) according to claim 1, characterized in that a guide sleeve (14) is provided in the cavity (10), which is in sliding contact with the shaft (5) and has limited play in an axial direction.

12. The rotating cleaner (1) according to claim 1, characterized in that the housing (2) has an outlet opening (20) which provides fluidic communication between the bearing gap and surroundings of the rotating cleaner (1).

13. The rotating cleaner (1) according to claim 1, characterized in that a spacer ring (17) is disposed between the idle bearing surface (22) and the rotating bearing surface (23).

14. The rotating cleaner (1) according to claim 1, characterized in that the sprayer body (3) is detachably mounted on the shaft (5).

15. The rotating cleaner (1) according claim 1, characterized in that the sprayer body (3) has an outlet, the shape of which causes the sprayer body (3) to rotate when fluid is discharged.

16. The rotating cleaner (1) according to claim 1, characterized in that it has a slot (8) extending along an axial direction (A) and penetrating a wall (21) of the sprayer body (3) at an incline counter to a radial direction (R).

* * * * *